United States Patent [19]

Carroll et al.

[11] Patent Number: 4,832,269

[45] Date of Patent: May 23, 1989

[54] CABLE CLIPPING

[75] Inventors: Clive R. E. Carroll, Ashtead; Debasish Sen, Woking, both of England

[73] Assignee: BICC Public Limited Company, London, England

[21] Appl. No.: 182,026

[22] Filed: Apr. 15, 1988

Related U.S. Application Data

[63] Continuation-in-part of Ser. No. 27,649, Mar. 19, 1987, abandoned, which is a continuation of Ser. No. 802,714, Nov. 27, 1985, abandoned.

[30] Foreign Application Priority Data

Dec. 7, 1984 [GB] United Kingdom ..... 8430916

[51] Int. Cl.[4] ..... B65H 54/04; B65H 55/00; B65B 63/04

[52] U.S. Cl. ..... 242/25 R; 242/54 R; 242/125.2; 242/172; 53/116; 53/430

[58] Field of Search ..... 242/25 R, 54 R, 125.2, 242/172, 164; 53/116, 128, 430; 206/389; 403/391, 397, 399; 24/336, 339, 543, 563

[56] References Cited

U.S. PATENT DOCUMENTS

| | | | |
|---|---|---|---|
| 1,519,018 | 12/1924 | Boudreau | 24/279 X |
| 2,895,605 | 7/1959 | Nash | 248/89 |
| 3,382,545 | 5/1968 | Spenner | 24/81 |
| 3,636,595 | 1/1972 | Wines | 24/339 X |
| 3,693,906 | 9/1972 | Robinson | 242/125.2 X |
| 4,407,472 | 10/1983 | Beck | 248/89 X |
| 4,534,522 | 8/1985 | Spence | 242/172 |
| 4,708,298 | 11/1987 | Allard et al. | 242/25 A |

*Primary Examiner*—David Werner

*Attorney, Agent, or Firm*—Anthony J. Casella; Gerald E. Hespos

[57] ABSTRACT

A coil of cable is formed by winding a predetermined length of cable (1) on to a spool (2) and fastening to the cable a clip (7), the clip including first and second recesses (8,9). Each recess receives a portion of the cable (1) to secure the free end (6) of the cable to the coil (3). The recesses (8,9) receive a portion of the penultimate turn (10) and final turn (11) respectively. The clip may be applied to the cable as the penultimate or final turns are being wound.

7 Claims, 4 Drawing Sheets

CABLE CLIPPING

Figure 1:
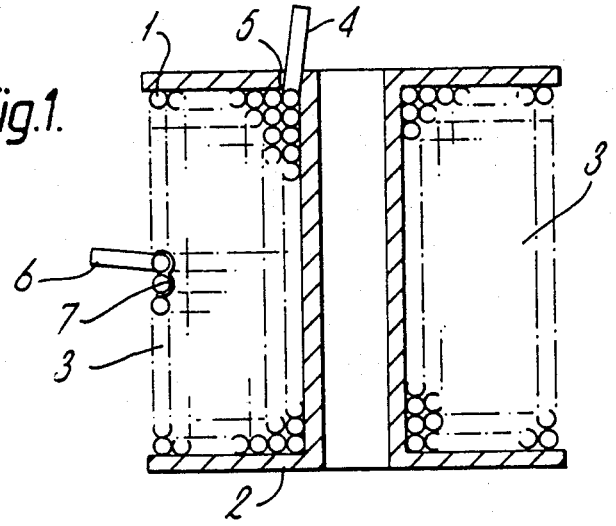

This application is a continuation-in-part of U.S. patent application Ser. No. 27,649 which was filed on Mar. 19, 1987, abandoned, which in turn was a continuation of U.S. patent application Ser. No. 802,714 which was filed on Nov. 27, 1985, abandoned.

This invention relates to a method in which the free end of a coil of electric cable, conductor, or other flexible elongate member (hereinafter referred to as 'cable') is secured to prevent the coil from becoming unwound.

Cables are generally wound on to spools, reels, drums etc (hereinafter referred to as 'spools') and then manually tied to prevent the free end from unravelling. The object of the present invention is to obviate this manual tying so that the cable winding can be further automated.

According to the present invention a method of forming a coil of cable comprises presenting a spool to winding apparatus; winding a predetermined length of cable on to the spool to form a coil; supporting, on a movable arm, an elongate clip including first and second recesses facing laterally of the longitudinal axis of the clip, each said recess being configured firmly to receive a portion of the cable; moving the arm to apply the clip to the cable at a location on the cable that will correspond to a designated turn of the coil which is either the penultimate or the final turn of the coil, such that a portion of the designated turn is received in one of the first and second recesses; and continuing winding the cable such that the final turn is wound on to the coil such that the other one of either the penultimate or the final turn of the coil is received in the other of the first and second recesses to prevent unwinding of the coil.

The winding apparatus is preferably as described in U.S. Pat. No. 4,708,298 and the disclosure thereof is incorporated herein by reference.

Preferably the portion of cable received in the first recess is a portion of the penultimate turn of the coil and the portion of the cable received in the second recess is a portion of the final turn of the coil. In this way the final turn of the coil is secured to the penultimate turn and hence to the remainder of the coil.

The invention further resides in a method of forming a coil of cable comprising presenting a spool to winding apparatus; winding a predetermined length of cable on to the spool to form a coil; supporting, on a movable arm, an elongate clip including first and second recesses facing laterally of the longitudinal axis of the clip, each said recess being configured firmly to receive a portion of the cable; moving the arm to apply the clip to the cable at a location on the cable that will correspond to the penultimate turn of the coil such that a portion of the penultimate turn of the coil is received in the first recess, and such that the second recess will be facing in a generally radially outward direction on the coil; and continuing winding the cable such that the final turn of the coil is received in the second recess to prevent unwinding of the coil.

The invention also resides in a method of forming a coil of cable comprising presenting a spool to winding apparatus; winding a predetermined length of cable on to the spool to form a coil; supporting, on a movable arm, an elongate clip including first and second recesses facing laterally of the longitudinal axis of the clip, each said recess being configured firmly to receive a portion of the cable; moving the arm to apply the clip to the cable at a location on the cable that will correspond to the final turn of the coil such that a portion of the final turn is received in the second recess, and such that the first recess will be facing in a generally inward direction on the coil; and continuing winding the cable such that the first recess of the clip is urged towards and firmly receives the penultimate turn of the coil to prevent unwinding of the coil.

Preferably there is provided means for detecting the interstice between adjacent turns of the coil. It is advantageous to be able accurately to engage the cable in the recesses, especially when non-circular cable is being wound.

The clip is conveniently formed of a resilient material, deformable to receive a portion of the cable within the recesses. The recesses are consequently of a slightly smaller dimension than the cable to be received, requiring flexing of the material to accommodate the cable. This provides a positive 'snap fit' for the cable in the recesses. Typically the clip is formed of a plastics material, but may also conceivably be of metal or rubber.

The clip is preferably provided with one or more projections, extending into either or both of the first and second recesses, and adapted to contact the cable when it is received therein to inhibit relative movement between the clip and the cable longitudinally of the cable. This helps to prevent sliding of the cable within the clip leading to loosening or even unravelling of a wound coil.

The invention further resides in the combination of an elongate clip including first and second recesses facing laterally of the longitudinal axis of the clip, each said recess being configured firmly to receive a portion of the cable; and apparatus for forming a coil of cable comprising means for rotatably mounting a spool, means for winding a predetermined length of cable on to the spool to form a coil, and a movable arm including means for supporting the clip, the arm being located with respect to the winding means such that movement of the arm applies the clip to the cable during the winding of a portion of the cable corresponding to a designated one of either the penultimate or final turns of the coil.

In a preferred arrangement the winding means includes a pivotable tube through which the cable passes, and the movable arm is located adjacent thereto with its longitudinal axis generally parallel to that of the pivotable tube.

Figure 4:
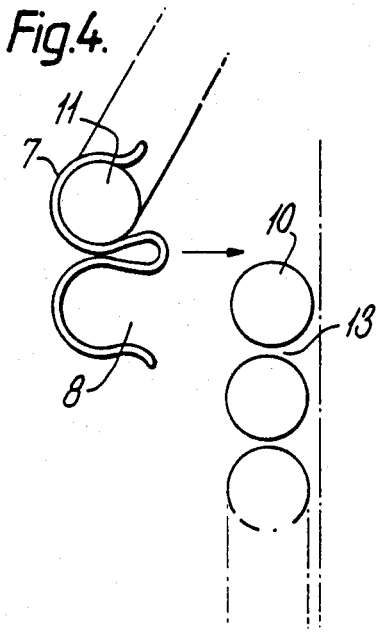
Figure 5:
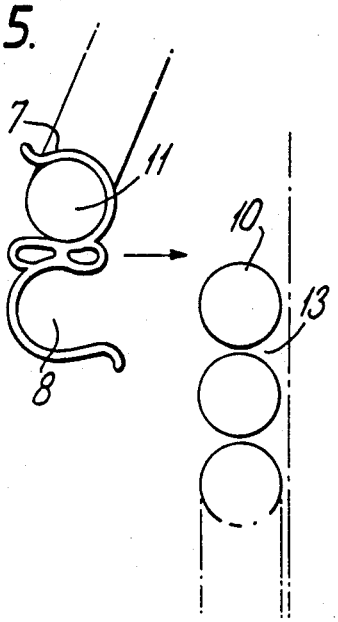
Figure 6:
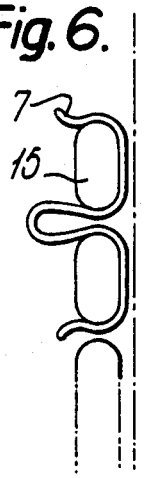
Figure 7:
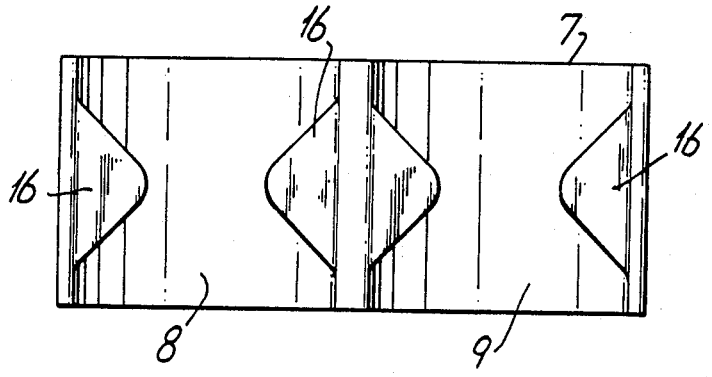
Figure 8:
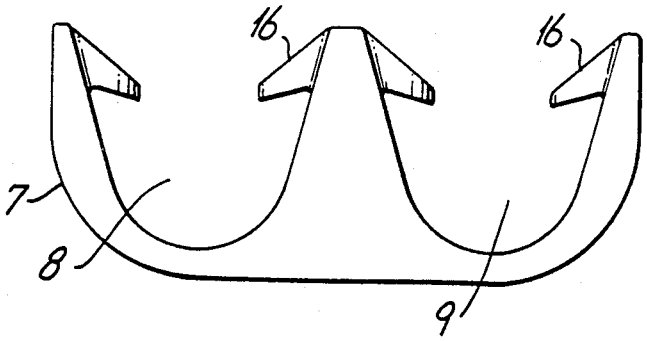
Figure 9:
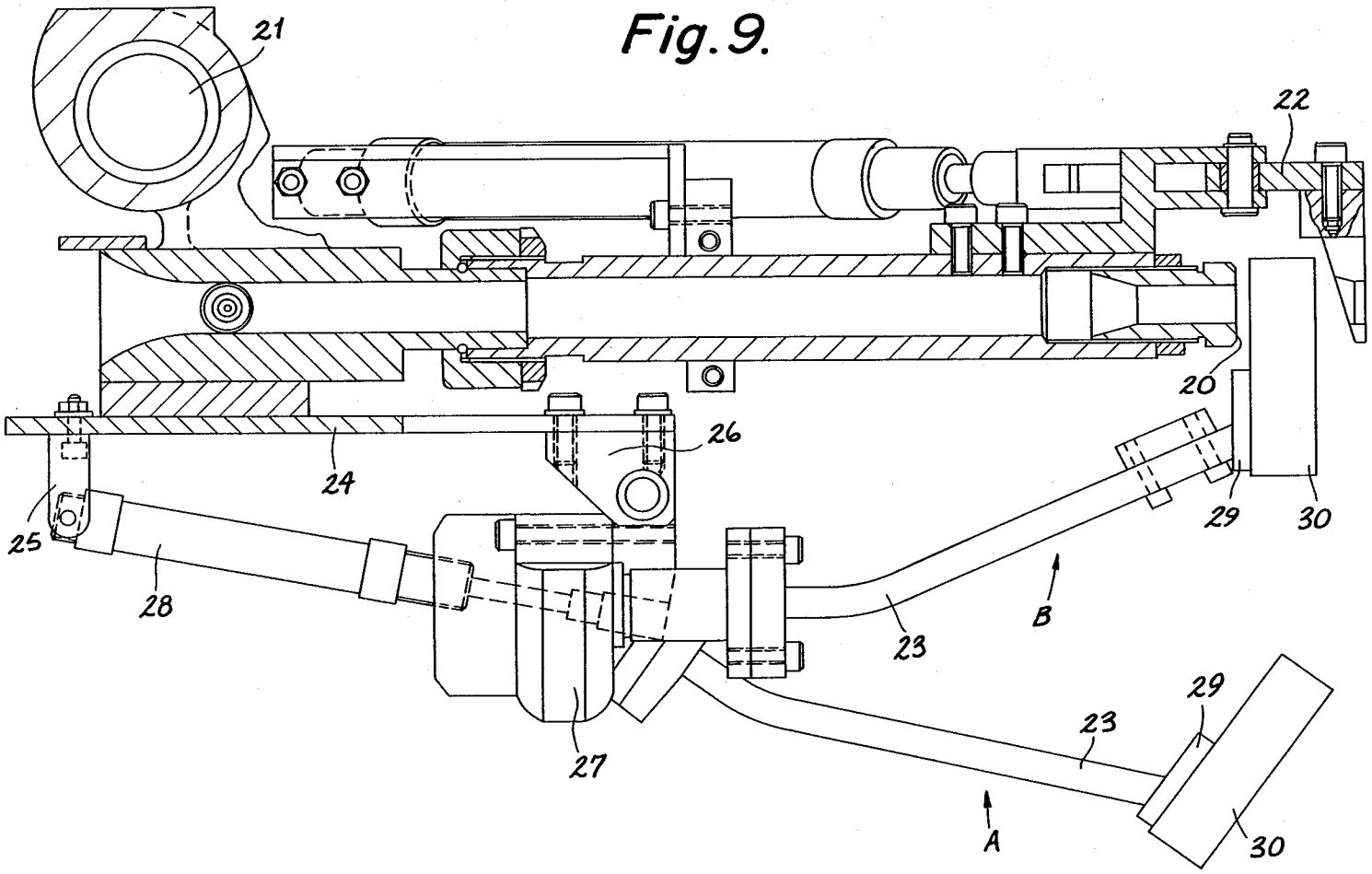

The invention will now be more particularly described by way of example only with reference to the accompanying drawings, in which:

FIG. 1 is a cross sectional view of a coil of cable formed in accordance with the present invention, FIG. 2 to 5 are schematic views of methods of fastening a clip in accordance with the present invention, FIG. 6 is a cross-sectional view of a clip for non-circular cable, FIGS. 7 and 8 are plan and elevational views respectively of a clip including projections for inhibiting the sliding movement of cable received therein, and FIG. 9 is a schematic cross-sectional diagram of apparatus according to the invention.

FIG. 1 shows a length of cable 1 which has been wound on to a spool 2 to form a coil as shown generally at 3. The inner end 4 of the cable 1 extends through an aperture 5 in the spool 2 and the free end 6 is secured to the coil by a clip 7. As can be seen more clearly in FIGS. 2 to 8, the clip 7 includes a first recess 8 and a second recess 9 separated by a central portion 12. The clip 7 is typically of a resilient plastics material.

Figure 2:
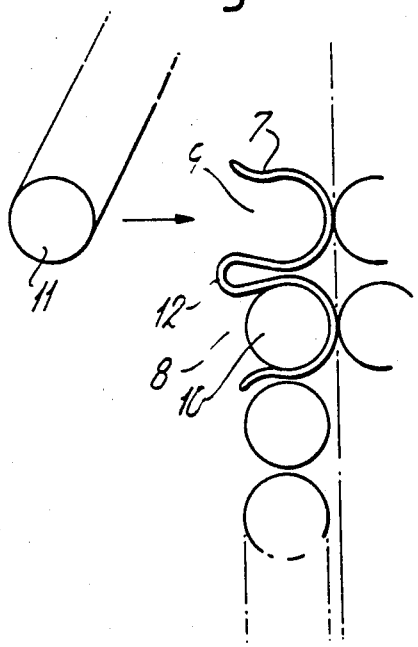

In FIG. 2 the clip 7 has been fastened on to the penultimate turn 10 of the coil by engaging the cable 1 in the recess 8. The cable is then wound such that the penultimate turn 10 is wound on to the coil with the recess 9 facing outwardly. Further winding of the cable causes the final turn 11 to be wound on to the coil such that it is received in the recess 9 due to the tension of the cable and is thereby secured by the clip 7.

Figure 3:
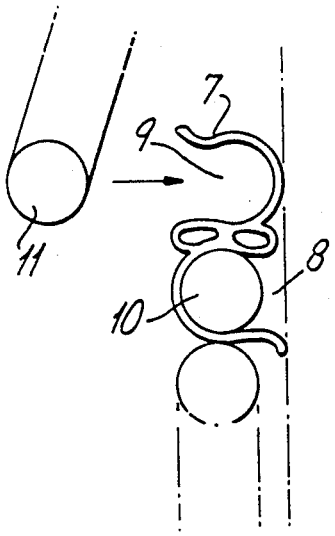

FIG. 3 shows a variation on the arrangement shown in FIG. 2 wherein the recess 8 which is used to fasten the clip 7 on to the penultimate turn 10 of the coil faces inwardly. The clip is therefore substantially 'S' shaped.

In FIG. 4 the penultimate turn 10 has already been wound on to the coil and the clip 7 is fastened on to the final turn 11 of the coil. As the final turn is wound on to the coil the penultimate turn 10 is receive in the recess 8. The penultimate turn 10 may be wound with a greater pitch to form a small gap 13 to aid in locating the clip 7 on the coil.

FIG. 5 shows a variation on the arrangement shown in FIG. 4 wherein the clip 7 is substantially 'S' shaped as depicted in FIG. 3. The method of operation is similar so that described above with reference to FIG. 4.

In FIG. 6 there is shown a clip 7 suitable for use with non-circular cable 15. Different clips are easily produced for use with differing types and sizes of cable.

FIGS. 7 and 8 show a clip 7 having projections 16, two of which extend into each of the recesses 8 and 9. The projections not only prevent the exit of the cable from the recesses, but also contact the cable to inhibit relative movement between the cable and the clip, longitudinally of the cable. In effect, the projections 16 prevent the clip from sliding longitudinally through the recesses. This helps to maintain a tightly wound coil of cable, should frictional contact between the cable 1 and clip 7 prove insufficient to prevent sliding of the cable within the recesses of the clip.

FIG. 9 shows apparatus for forming coils of cable, the apparatus including a cylindrical tube 20 through which cable is passed. The tube 20 is pivotable about pivot mounting 21 so that it can accommodate a change in the angle of lay as the coil of cable is wound. Attached to the tube 20 is cable bending means shown generally at 22, employed to bend the end of the cable through 90° prior to insertion on to a spool.

A movable arm 23 is also attached to the tube via mounting plate 24 and supports 25 and 26. The arm includes an articulated joint shown generally at 27 and is operated by a pneumatic cylinder 28. At the end of the arm 23 is a holder 29 in which is received a clip 30.

The operation of the apparatus is as follows. The arm is normally located in a position A, pivoted away from the tube 20. A clip is inserted into the holder 29, either manually or by automatic means (not shown). Cable passes through the tube 20 and is wound on to a spool to form a coil. At a given signal the pneumatic cylinder 28 causes the arm to move to position B in which the clip 30 is applied to the cable at a location corresponding to either the penultimate or final turn of the coil. The cylinder 28 is actuated again to retract the arm to position A in which a further clip is inserted into the holder and the process is repeated.

We claim:

1. A method of forming a coil of cable comprising presenting a spool to winding apparatus; winding a predetermined length of cable on to the spool to form a coil; supporting, on a movable arm, an elongate clip including first and second recesses facing laterally of the longitudinal axis of the clip, each said recess being configured firmly to receive a portion of the cable; moving the arm to apply the clip to the cable at a location on the cable that will correspond to a designated turn of the coil which is either the penultimate or the final turn of the coil, such that a portion of the designated turn is received in one of the first and second recesses; and continuing winding the cable such that the final turn is wound on to the coil such that the other one of either the penultimate or the final turn of the coil is received in the other of the first and second recesses to prevent unwinding of the coil.

2. A method according to claim 1 wherein the clip is formed of a resilient material, deformable to receive a portion of the cable within the recesses.

3. A method according to claim 1 wherein the clip is provided with one or more projections, the projections extending into at least one of the first and second recesses, the projections being configured to contact the cable when it received therein to inhibit relative movement between the clip and the cable, longitudinally of the cable.

4. A method of forming a coil of cable comprising presenting a spool to winding apparatus; winding a predetermined length of cable on to the spool to form a coil; supporting, on a movable arm, an elongate clip including first and second recesses facing laterally of the longitudinal axis of the clip, each said recess being configured firmly to receive a portion of the cable; moving the arm to apply the clip to the cable at a location on the cable that will correspond to the penultimate turn of the coil such that a portion of the penultimate turn of the coil is received in the first recess, and such that the second recess will be facing in a generally radially outward direction on the coil; and continuing winding the cable such that the final turn of the coil is received in the second recess to prevent unwinding of the coil.

5. A method of forming a coil of cable comprising presenting a spool to winding apparatus; winding a predetermined length of cable on to the spool to form a coil; supporting, on a movable arm, an elongate clip including first and second recesses facing laterally of the longitudinal axis of the clip, each said recess being configured firmly to receive a portion of the cable; moving the arm to apply the clip to the cable at a location on the cable that will correspond to the final turn of the coil such that a portion of the final turn is received in the second recess, and such that the first recess will be facing in a generally inward direction on the coil; and continuing winding the cable such that the first recess of the clip is urged towards and firmly receives the penultimate turn of the coil to prevent unwinding of the coil.

6. In combination, an elongate clip including first and second recesses facing laterally of the longitudinal axis of the clip, each said recess being configured firmly to receive a portion of the cable; and apparatus for forming a coil of cable comprising means for rotatably mounting a spool, means for winding a predetermined length of cable on to the spool to form a coil, and a movable arm including means for supporting the clip, the arm being located with respect to the winding means such that movement of the arm applies the clip to the cable during the winding of a portion of the able corresponding to a designated one of either the penultimate or final turns of the coil.

7. A combination as claimed in claim 6 wherein the winding means includes a pivotable tube through which the cable passes, and the movable arm is located adjacent thereto with its longitudinal axis generally parallel to that of the pivotable tube.

* * * * *